US005249019A

United States Patent [19]

Ishida et al.

[11] Patent Number: 5,249,019

[45] Date of Patent: Sep. 28, 1993

[54] FEED ROLLER FOR MIXING AND FEEDING A POWDER

[75] Inventors: Hideki Ishida, Yao; Hiroshi Kusumoto, Wakayama; Naruyuki Miyamoto, Sakai; Yoshifumi Ishii, Daito; Shoichi Kitagawa, Neyagawa, all of Japan

[73] Assignee: Mita Industrial Co., Ltd., Osaka, Japan

[21] Appl. No.: 823,056

[22] Filed: Jan. 17, 1992

Related U.S. Application Data

[63] Continuation of Ser. No. 611,709, Nov. 13, 1990, abandoned.

[30] Foreign Application Priority Data

Nov. 29, 1989 [JP] Japan ..... 1-310955
Nov. 29, 1989 [JP] Japan ..... 1-310960
Nov. 29, 1989 [JP] Japan ..... 1-310961

[51] Int. Cl.[5] ..... G03G 21/00
[52] U.S. Cl. ..... 355/246; 366/318
[58] Field of Search ..... 355/245, 246, 251, 253, 355/200; 118/653, 657, 658; 366/318, 319, 322, 327, 329, 81, 82, 88, 89, 90

[56] References Cited

U.S. PATENT DOCUMENTS 3,271,819 9/1966 Lacher ..... 366/89
4,711,551 8/1987 Fujio et al. .
4,963,033 10/1990 Huber et al. ..... 366/89 X

FOREIGN PATENT DOCUMENTS 0161795 11/1985 European Pat. Off. .
60-140969 3/1985 Japan .
60-140969 9/1985 Japan .
184068 12/1985 Japan .
60-184068 12/1985 Japan .
61-197026 9/1986 Japan .
62-47072 2/1987 Japan ..... 355/253
62-53459 4/1987 Japan .
62-87735 6/1987 Japan .
62-209573 9/1987 Japan ..... 355/245
63-47353 3/1988 Japan .
63-047353 4/1988 Japan .
63-205681 8/1988 Japan ..... 355/245
1-10277 1/1989 Japan ..... 355/245
64-21468 1/1989 Japan .

OTHER PUBLICATIONS

European Search Report dated Nov. 10, 1992.

*Primary Examiner*—A. T. Grimley
*Assistant Examiner*—Shuk Y. Lee
*Attorney, Agent, or Firm*—Beveridge, DeGrandi, Weilacher & Young

[57] ABSTRACT

In a feed roller for mixing a developer and feeding it to a developing roller, a first mixing wing parallel to a rotating shaft is provided, a second spiral-shape mixing wing is diagonally provided in a manner to cross the first wing, and a spiral-shape groove for feeding a powder is formed on the one side located on the forward section with respect to rotating direction and being the powder scraping-up side of the both sides of said second mixing wing, along said second mixing wing, so as to enhance the feed performance, lateral-mixing performance and lateral-feed performance of the feed roller.

7 Claims, 12 Drawing Sheets

FEED ROLLER FOR MIXING AND FEEDING A POWDER

This application is a continuation of application Ser. No. 07/611,709, filed Nov. 13, 1990, now abandoned.

BACKGROUND OF THE INVENTION

1. Field of the Invention

The present invention relates to a feed roller used for developing devices in image-forming apparatuses such as copying machines and for powder-mixing apparatuses.

2. Description of the Related Art

Heretofore, as a mixing roller for mixing a developer in developing devices arranged in image-forming apparatuses or as a feed roller for feeding the developer to a developing roller, the following rollers have been devised:

a. A vibration-type mixing roller whose spiral-shape mixing wing has a cutout as shown in FIG. 1 (Japanese Laid-open Patent Publication No. 197026/1986);

b. A screw-type spiral roller as shown in FIG. 2 (Japanese Laid-open Utility Model Publication No. 87735/1987);

c. A mixing roller having a mixing wing parallel to a rotating shaft thereof and a spiral groove to prevent pressure rise as shown in FIG. 3 (Japanese Laid-open Utility Model Publication No. 47353/1988);

d. A roller having a feed roller with a flat wing and including a spiral roller near the feed roller as shown in FIG. 4 (Japanese Laid-open Utility Model Publication No. 184068/1985);

e. A feed roller having an opening located on the backward section with respect to the rotating direction of a spiral-shape mixing wing as shown in FIG. 5 (Japanese Laid-open Utility Model Publication No. 53459/1987); and f. A feed roller having a spiral wing having a rectangular plane member as shown in FIG. 6 (Japanese Laid-open Utility Model Publication No. 140969/1985).

However, among the above-described mixing rollers or feed rollers, the spiral-shape rollers as shown in the items a, b and e have had a problem that they have a small capability to feed a developer to a developing roller, and the roller having an auxiliary lateral-feed mechanism as shown in the item d or the one having a mixing wing parallel to a rotating shaft thereof as shown in the item c have a problem that they have a poor lateral mixing performance and particularly the one of spiral-shape as shown in the item f has a problem that they scrape up developer diagonally to a developing roller.

Also, as an another type of roller, a roller having a shaft and lateral-feed blades mounted on the shaft is available. The lateral-feed blades are designed to laterally feed a developer and mix the developer so as to keep proper fluidization balance of the developer. For example, as disclosed in Japanese laid-open Patent Publication No. 21468/1989, a roller is known in which the screw pitch of lateral-feed blades S is made large on the start side in the screw-conveyance direction and small on the end side (see FIG. 7).

However, such prior art mixing rollers have had a problem that, since their lateral-feed blades are continuous spiral-shape blades, when an attempt is made to change variously their pitch with shaft position, the density of blades at a place of large pitch becomes inevitably coarse, thereby causing the developer lateral-feed force not to be increased.

SUMMARY OF THE INVENTION

The present invention intends to solve the above-described problems. Therefore, an object of the present invention is to provide a feed roller which feeds a sufficient quantity of developer to a developing roller, improves lateral-mixing performance and has an excellent lateral-feed performance.

The present invention is characterized in that, in a feed roller for mixing a powder such as developer, a first mixing wing provided parallel to a rotating shaft thereof and a second spiral-shape mixing wing provided diagonally to the shaft are formed crossing each other, and a spiral-shape groove for feeding a powder is formed on the one side, located on the forward section with respect to rotating direction and being the powder scraping-up side, of the both sides of the second mixing wing, along the second mixing wing.

The present invention is arranged in such a manner as described above, so that the first mixing wing feeds vertically a powder to the next process while mixing the powder in the rotating direction, and the second mixing wing laterally feeds the powder while mixing the powder in the lateral direction.

Further, the groove for feeding the powder causes the sliding of the powder on the second mixing wing to become better, thereby allowing the lateral-feed capability to be improved.

Also, the present invention is a feed roller having a shaft and lateral-feed blades fixed to the shaft to laterally feed a powder, and characterized in that each lateral-feed blade is constant in pitch and differs in size axially.

The present invention is arranged in such a manner as described above and each lateral-feed blade is constant in pitch though differing in size axially, so that, without such a defect that the reduced density of the lateral-feed blades causes the lateral-feed force to be significantly reduced, the size of the blades can be properly designed to changed properly the lateral-feed capability axially.

Also, the present invention is a feed roller having a shaft, lateral-feed blades fixed to the shaft and at least two pass partition plates formed axially to laterally and longitudinally feed a powder, and characterized in that the size of the longitudinal-feed pass partition plates differs axially.

The present invention is arranged in such a manner as described above and the size of the longitudinal-feed pass partition plates differs axially, so that, without such a defect that the density of the lateral-feed blades is reduced, the longitudinal-feed force can be changed to change relatively the lateral-feed force.

Also, the present invention is a feed roller having a shaft and lateral-feed blades fixed to the shaft to laterally feed a powder, and characterized in that each lateral-feed blade in a plurality of regions formed by at least two borders formed axially is discontinuous and independent each other, and constant in pitch and differs in inclination.

The present invention is arranged in such a manner as described above and each lateral-feed blade in a plurality of regions formed by at least two borders formed axially is discontinuous and independent each other, so that each lateral-feed blade in each region can be made constant in pitch and different in inclination. Accordingly, the reduction of the density of the lateral-feed blades is not required.

Also, the present invention is a feed roller having a shaft and lateral-feed blades fixed to the shaft to laterally feed a powder, and characterized in that each lateral-feed blade in a plurality of regions formed by at least two borders formed axially is discontinuous and independent to each other, and constant in inclination and differs in pitch.

The present invention is arranged in such a manner as described above and each lateral-feed blade in a plurality of regions formed by at least two borders formed axially is discontinuous and independent to each other, so that each lateral-feed blade in each region can be made constant in inclination and different in pitch.

BRIEF DESCRIPTION OF THE DRAWINGS

FIG. 10(*b*) is a front view of the embodiment.

PREFERRED EMBODIMENTS OF THE INVENTION

Based on the drawings showing embodiments, the present invention is described hereinafter. First, an image-forming apparatus using a feed roller according to the present invention is and then a developing device of the apparatus, arranging the feed roller is described.

Figure 1:
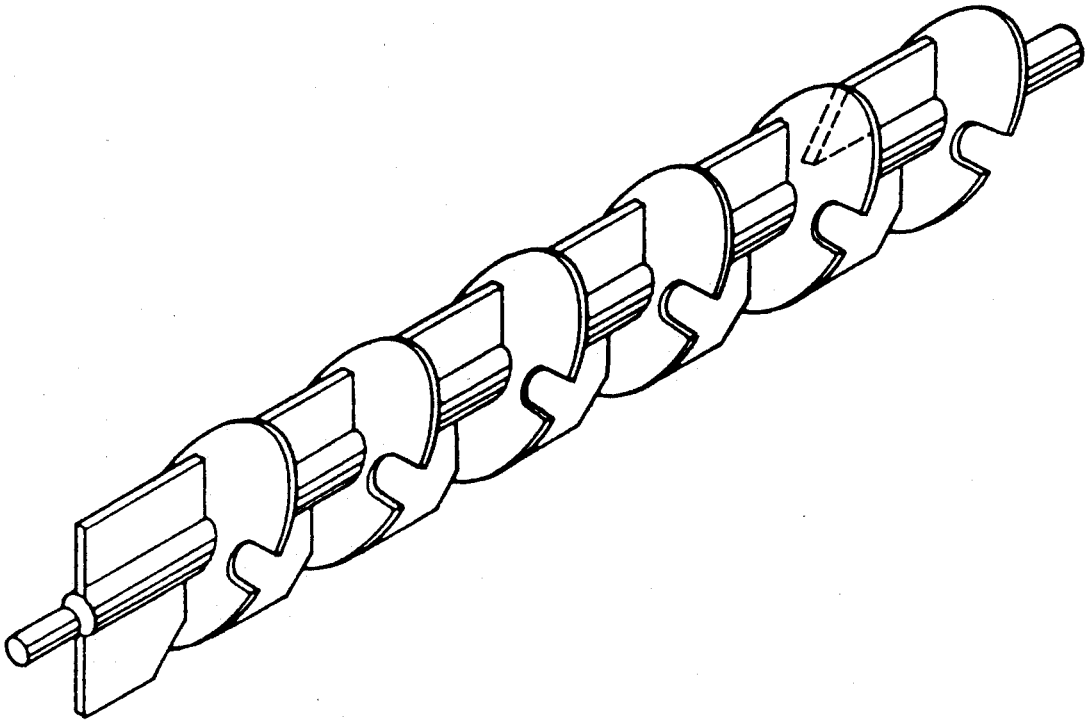
Fig. 1 (PRIOR ART)
FIGS. 1 through 7 are views of prior art feed rollers.
Figure 2:
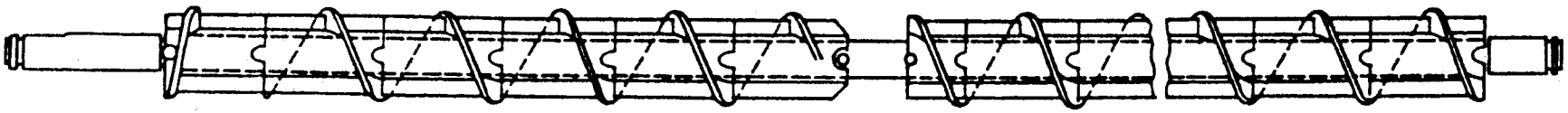
Fig. 2 (PRIOR ART)
Figure 3:
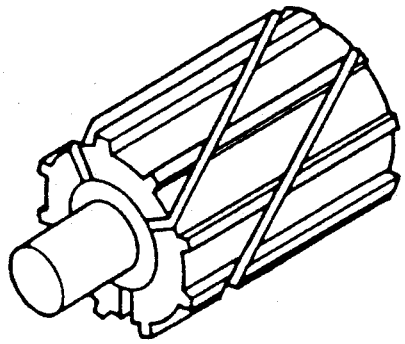
Fig. 3 (PRIOR ART)
Figure 4:
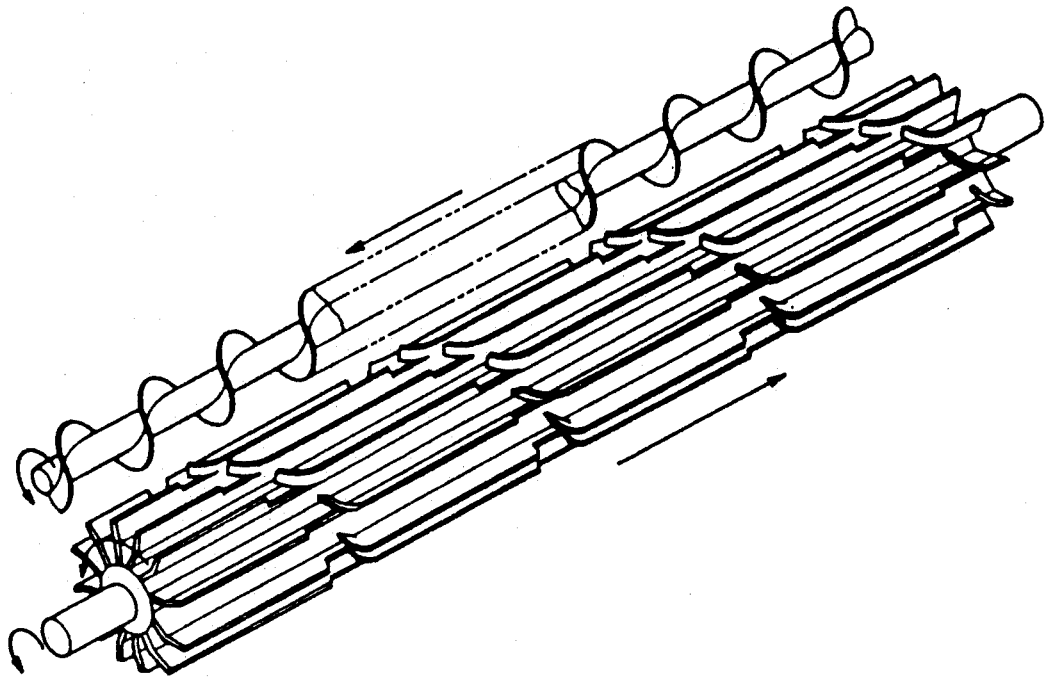
Fig. 4 (PRIOR ART)
Figure 5:
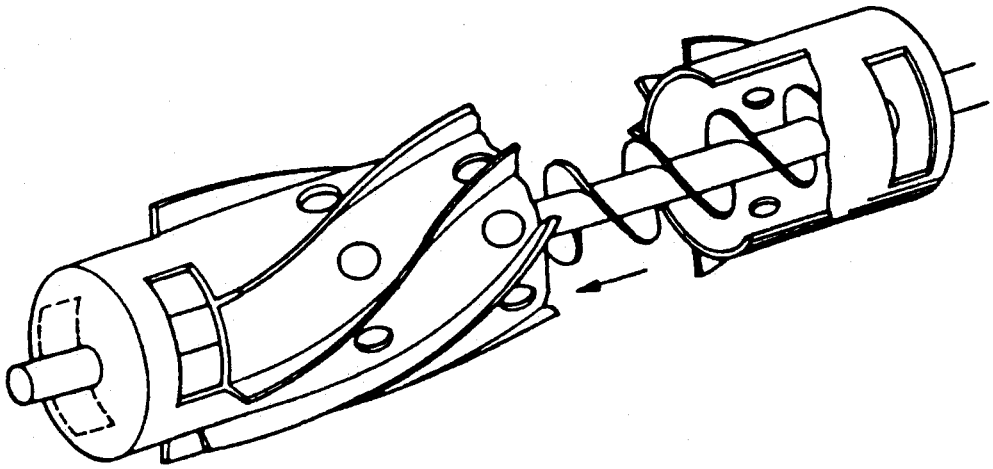
Fig. 5 (PRIOR ART)
Figure 6:
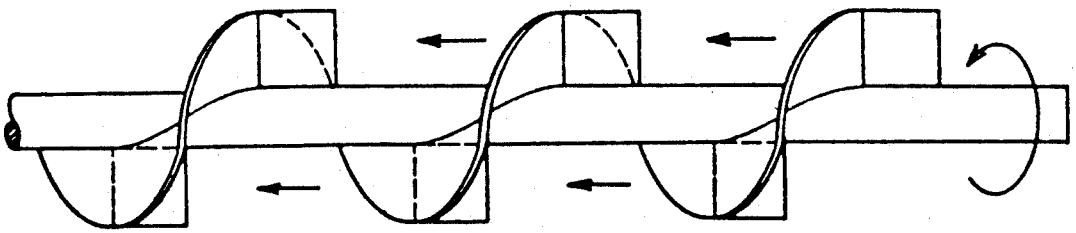
Fig. 6 (PRIOR ART)
Figure 7:
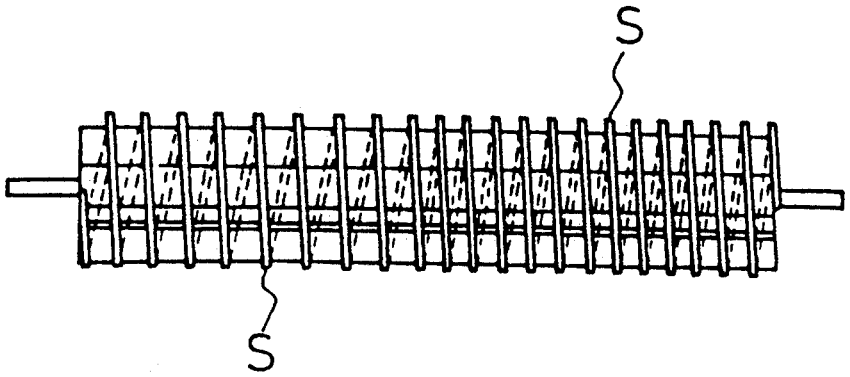
Fig. 7 (PRIOR ART)
Figure 8:
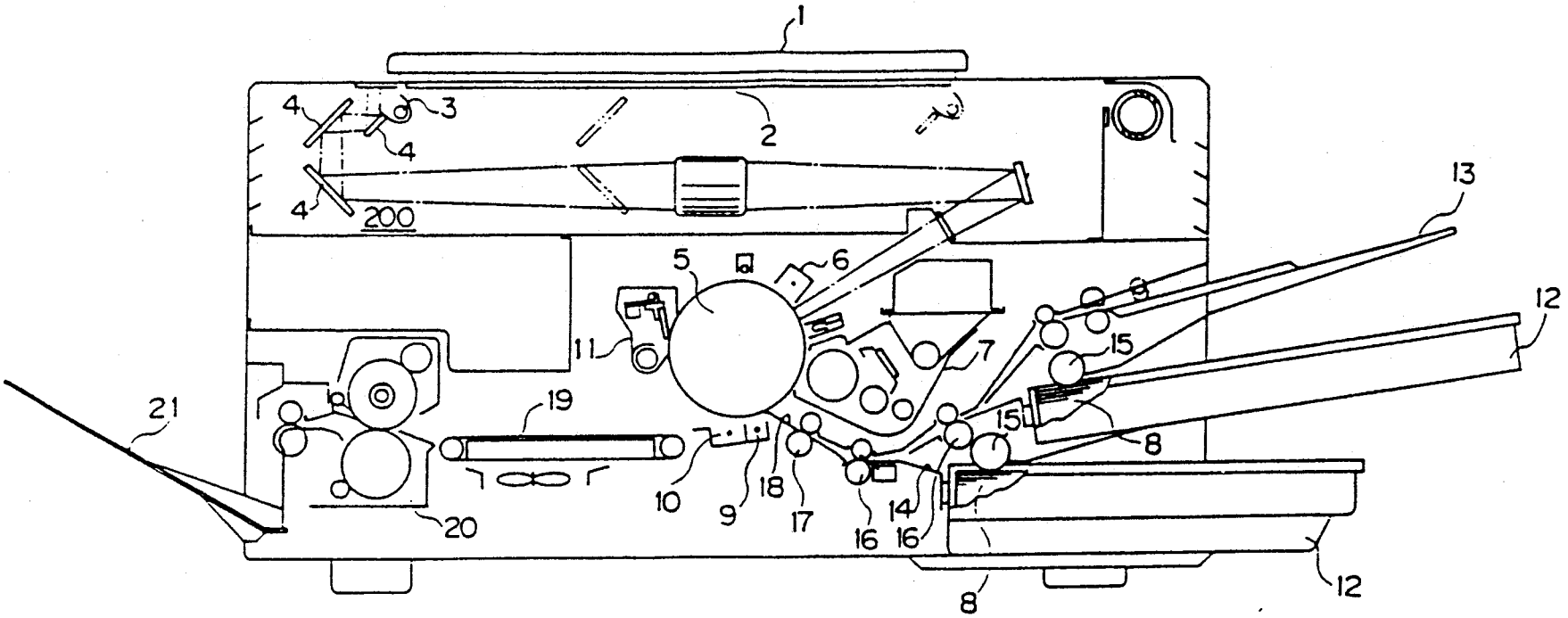
FIG. 8 is a schematic sectional view of an image-forming apparatus using a feed roller according to the present invention.

FIG. 8 is a schematic sectional view showing an image-forming apparatus using a feed roller according to the present invention.

On the upper part of the apparatus, a manuscript placing plate 2 for placing a manuscript, a manuscript cover 1, and an optical system 200 including a lamp 3 and reflection mirrors 4 are provided. The optical system 200 moves in such a manner as to scan a manuscript along the manuscript placing plate 2.

On the periphery of an image carrier 5, a main electrifier 6 for electrifying the image carrier 5, a developing device 7 for toner-developing a latent image on the image carrier 5 formed by being exposed to the image light entered from the optical system 200, a transfer device 9 for transferring the toner-image-developer to a sheet 8, a separator 10 for separating the sheet 8 from the image carrier 5, a cleaner 11 for cleaning a toner remaining after the transferring, and the like are arranged.

On the upstream side of the transfer device 9, a conveyance path 14 for conveying the sheet 8 from a sheet feed cassette 12 for feeding the sheet 8 or from a hand insertion tray 13 is provided. Also, on the conveyance path 14, a sheet feed roller 15, a conveyance roller 16, a resist roller 17 and the like are arranged, and a sheet guide plate 18 is provided directly upstream the transfer device 9.

On the downstream side of the separator 10, a conveyance belt 19 is provided, which conveys the separated sheet 8 to a thermal fixer 20. The thermal fixer 20 melts and fixes a toner image on the sheet 8. The toner-fixer sheet 8 is discharged onto a discharge tray 21.

Figure 9:
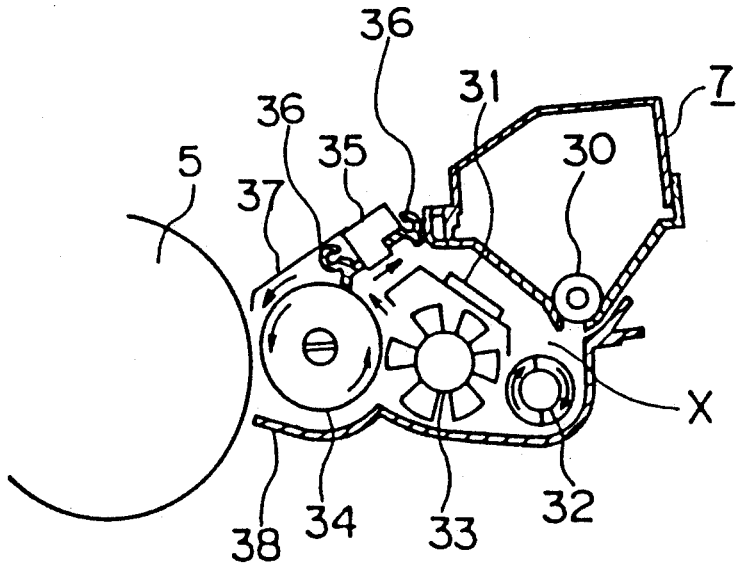
FIG. 9 is a sectional view of a developing device of the image-forming apparatus.

With reference to FIG. 9, the developing device of the image-forming apparatus is described hereinafter.

In FIG. 9, a toner supply roller 30 for supplying a toner is provided on the diagonally upper side within the developing device 7. Under the toner supply roller 30, a mixing roller 32 for mixing a developer X returned from a pass partition plate 31 with the toner from the toner supply roller 30 is provided; a feed roller 33 for feeding the developer X mixed by the mixing roller 32 to a developing roller 34 is provided on the image carrier 5 side; and the developing roller 34 is provided close to the image carrier 5. On the developing device 7, a toner sensor 35 is arranged, and an ear cut plate stay 36 and a developing-slit plate 37 are provided. Also, a developing housing 38 covers the developing device 7.

The operation in the developing device 7 is described hereinafter. The developer X is mixed by the mixing roller 32 and fed to the feed roller 33. The feed roller 33 feeds a new developer X mixed to the developing roller 34. And, the developer X having not ridden on the developing roller 34 by the ear cutting of the ear cut plate stay 36 is fed onto the pass partition plate 31. Then, the developer X having passed through the pass partition plate 31 is returned to the mixing roller 32.

Figure 10B:
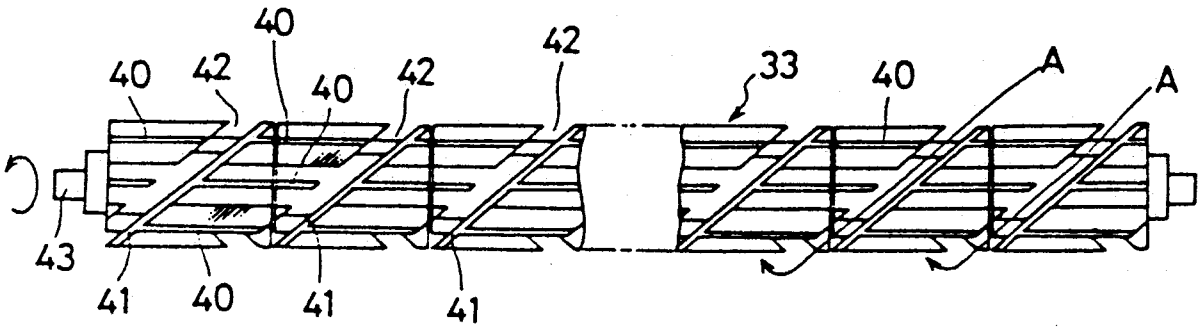
FIG. 10(*a*) is a side view of one embodiment of a feed roller according to the present invention.
Figure 11:
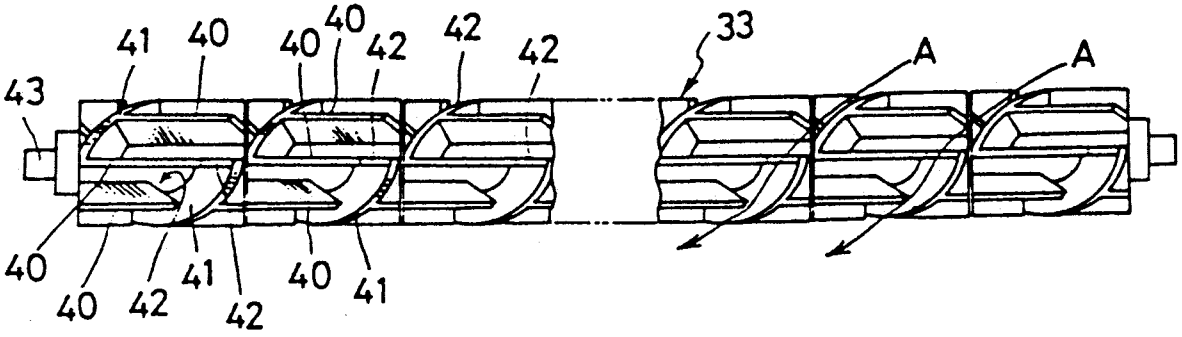
FIG. 11 is a front view of the feed roller shown in FIG. 10(*b*) when rotated about 45 degrees.
Figure 10A:
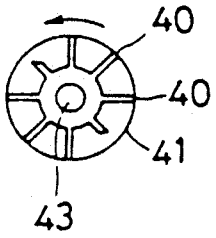

With reference to FIGS. 10 and 11, one embodiment of the feed roller 33 which is provided on the developing device 7 in accordance with the present invention is described hereinafter. FIG. 10(*a*) is a side view of the feed roller 33, and FIG. 10(*b*) is a front view of the roller. FIG. 11 is a front view of FIG. 10(*b*) when rotated about 45 degrees.

In FIGS. 10 and FIG. 11, a first mixing wing 40 is provided parallel to a rotating shaft 43, and the three-step first mixing wings 40, 40 and 40 are seen in both FIG. 10(*b*) and FIG. 11. A second mixing wing 41 is diagonally provided and of spiral-shape. The first mixing wing 40 and the second mixing wing 41 are formed crossing each other in the lateral direction (axially). A spiral-shape groove 42 for moving a developer is formed on the one side located on the forward section with respect to rotating direction (on the powder scraping-up side) of the both sides of the second mixing wing 41, along the second mixing wing 41.

The operation of the above-described embodiment according to the present invention is described hereinafter. The first mixing wing 40 can feed vertically a developer to the developing roller 34. The second mixing wing 41, though of course mixes the developer and feeds it in lateral direction, is provided with the groove 42 for feeding the developer, so that the sliding of the developer on the second mixing wing 41 becomes better, thereby causing the developer lateral-feed capability to be improved (see arrow A).

The adjustment of the clearance of the groove 42 for feeding a developer allows the lateral-feed of lateral mixing to be adjusted. Further, even after the completion of a mold, a little adjustment can be performed.

Also, where, using the feed roller 33 and a spiral-shape roller having a capability of lateral-feed in the opposite direction to the feed roller 33, mixing is made balanced, the apparatus performance is less affected by developer toner concentration difference and environmental conditions (such as humidity and apparatus installing condition).

The feed roller in the present invention includes the mixing roller in addition to the feed roller in a narrow sense.

Also, although, in the above-described embodiment, small block units are combined to form the feed roller, of course an integrally molded feed roller may be accepted.

The feed roller according to the present invention can be used for apparatuses for mixing a powder besides image-forming apparatuses.

As described above, the present invention is such that the first mixing wing provided parallel to the rotating shaft and the second spiral-shape mixing wing provided diagonally to the shaft are formed crossing each other, and the spiral-shape groove for feeding a powder is formed on the one side located on the forward section with respect to rotating direction of the both sides of the second mixing wing, along the second mixing wing, so that the groove for feeding a powder causes the sliding of the powder on the second mixing wing to become better, thereby allowing lateral-mixing performance and lateral-feed performance to be improved. Further, the first mixing wing can feed a sufficient quantity of powder to the roller of the next process.

With reference to drawings showing embodiments, another present invention is described hereinafter.

Figure 12:
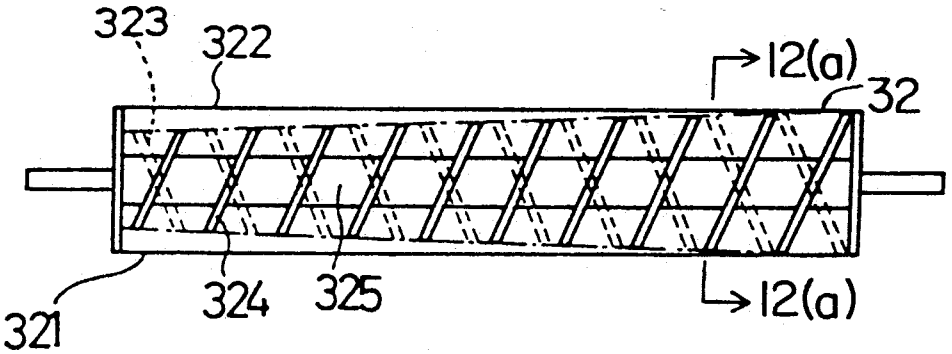
FIG. 12(*a*) and FIG. 12(*b*) are a side view and a front view, respectively, showing one embodiment of another mixing roller according to the present invention.
Figure 13:
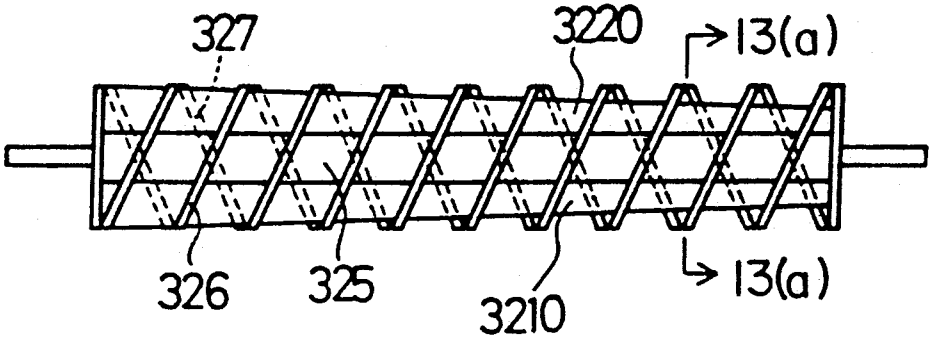
FIG. 13(*a*) and FIG. 13(*b*) are a side view and a front view, respectively, showing one embodiment of another mixing roller according to the present invention.
Figure 12:
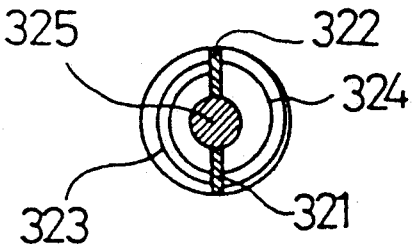
Figure 13:
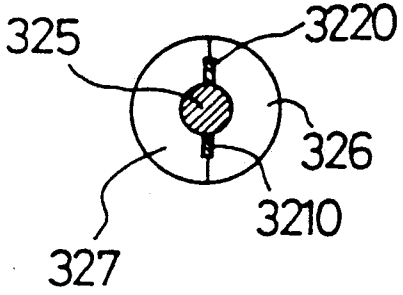

With reference to FIGS. 12 and 13, another mixing roller 32 which is arranged in the developing device 7 and in accordance with the present invention will be explained.

FIG. 12 (*a*) is an A—A (see FIG. 12 (*b*)) sectional view showing one embodiment of the mixing roller 32 according to the present invention, and FIG. 12 (*b*) is a front view of the mixing roller 32. FIG. 13 (*a*) is a B—B (see FIG. 13 (*b*)) sectional view showing one embodiment of a mixing roller according to another present invention, and FIG. 13 (*b*) is a front view of the mixing roller.

In FIG. 12, pass partition plates 321 and 322 are provided axially on the upper and lower parts of a shaft 325, respectively. The pass partition plates 321 and 322 are plates which feed vertically against the axis of the shaft 325 (longitudinal-feed) a developer by rotation of the shaft 325, and have a function to scrape up the developer. The height of the pass partition plates 321 and 322 are constant axially.

Also, on the shaft 325, lateral-feed blade group 323 and 324 are provided. The pitch of these blades is constant. Thus, the pitch is the same, so that the density of the lateral-feed blades 323 and 324 is the same at any place. But, the size of the lateral-feed blades 323 and 324 differs axially. For example, as shown in FIG. 12, the size becomes smaller stepwise toward the one end. Accordingly, without a significant reduction of lateral-feed capability, the lateral-feed capability can be properly changed axially, that is, the lateral-mixing capability can be changeable any place.

Although, in the above-described embodiment, the pass partition plates 321 and 322 are provided, another member not limited to such pass partition plate may be accepted, and even the absence of the plates or member also be accepted.

In FIG. 13, pass partition plates 3210 and 3220 are provided axially on the upper and lower parts of a shaft 325, respectively. The pass partition plates 3210 and 3220 are plates which feed vertically against the axis of the shaft 325 (longitudinal-feed) a developer by rotation of the shaft 325, and have a function to scrape up the developer. The height of the pass partition plates 3210 and 3220 differs axially. For example, as shown in FIG. 13, the height becomes smaller stepwise toward the one end.

Also, on the shaft 325, lateral-feed blade group 326 and 327 are provided. The pitch of these blades is constant. The size of the lateral-feed blades 326 and 327 is also constant axially. Thus, the pitch is the same, so that the density of the lateral-feed blades 326 and 327 is the same at any place. Accordingly, no significant reduction of lateral-feed capability occurs. Further, as described above, the pass partition plates 3210 and 3220 for longitudinal-feed differs axially, so that the interaction between the pass partition plates 3210 and 3220 and the lateral-feed blades 326 and 327 allows the lateral-feed capability to be properly changed axially.

Further a mixing roller of another present invention can be formed by combining the lateral-feed blades 323, 324 as shown in FIG. 12 with the pass partition plates 3210, 3220 for longitudinal-feed as shown in FIG. 13. The combination method is such that each lateral-feed capability is integrated to produce a desired lateral-feed force.

The mixing roller in the present invention includes the feed roller in addition to the mixing roller in a narrow sense.

The present invention can be applied to mixing rollers for mixing another powder, not limited to image-forming apparatuses.

In the present invention as described above, each lateral-feed blade is constant in pitch and differs in size axially, so that, without a significant reduction of lateral feed capability, a desired lateral-feed capability can be attained.

Also, in the present invention, the size of the pass partition plates for longitudinal-feed differs axially, so that, without a significant reduction of lateral-feed capability, a desired lateral-feed capability can be attained.

With reference to drawings showing embodiments, another present invention is described hereinafter.

Figure 14:
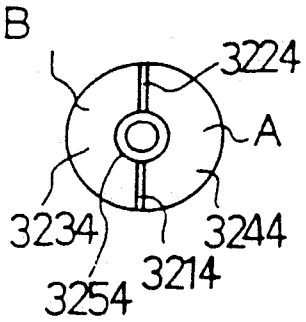
FIG. 14(*a*) and FIG. 14(*b*) are a side view and a front view, respectively, showing one embodiment of another mixing roller according to the present invention.
Figure 14:
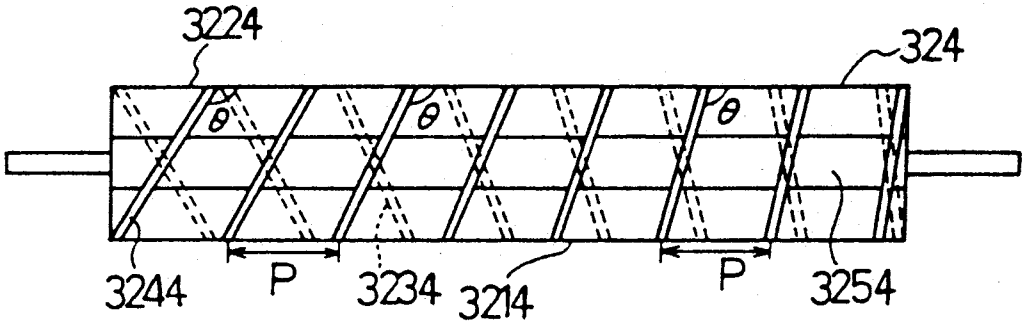
Figure 15:
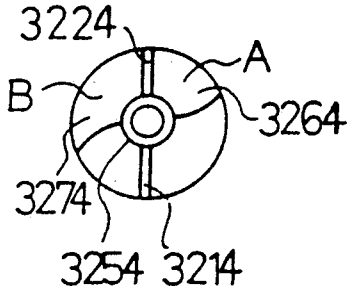
FIG. 15(*a*) and FIG. 15(*b*) are a side view and a front view, respectively, showing one embodiment of another mixing roller according to the present invention.
Figure 15:
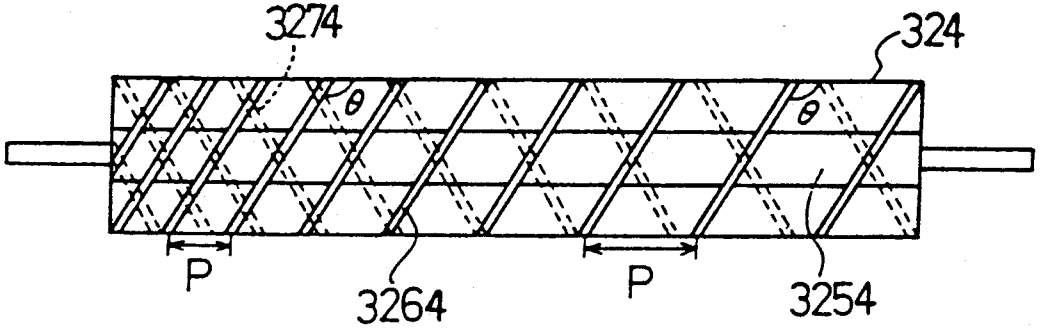

With reference to FIGS. 14 and 15, the mixing roller 32 which is arranged in the developing device 7 and in accordance with the present invention will be explained.

FIG. 14 (*a*) is a side view showing one embodiment of the mixing roller 324 according to the present invention, and FIG. 14 (*b*) is a front view of the mixing roller 324. FIG. 15 (*a*) is a side view showing one embodiment of another mixing roller according to the present invention, and FIG. 15 (*b*) is a front view of the mixing roller.

In FIG. 14, pass partition plates 3214 and 3224 are provided axially on the upper and lower parts of a shaft 3254, respectively. The pass partition plates 3214 and 3224 are plates which feed vertically against the axis of the shaft 3254 a developer by rotation of the shaft 3254, and have a function to scrape up the developer. With the pass partition plates 3214 and 3224, the shaft 3254 is partitioned into two regions A and B. Accordingly, the pass partition plates 3214 and 3224 can be said to form a border. In the present embodiment, the shaft 3254 is partitioned into the front and back on the drawing, two regions A and B.

The front and back regions A and B are provided with independent lateral-feed blade group 3234 and 3244 which are not required to be continuous each other.

Thus, the lateral-feed blades 3234 and 3244 in the front and back regions, A and B, are discontinuous each other, so that pitch, inclination and the like of the lateral-feed blade group 3234 and 3244 can be freely set. That is, in the present embodiment, the pitch P is designed with the same value at any place of the shaft 3254. The inclination differs stepwise. Also, as seen from the drawing, the density of the lateral-feed blades 3234 and 3244 is constant at any place. By such design, without a reduction of lateral-feed force, the lateral-feed force can be properly changed with place.

In FIG. 15, pass partition plates 3214 and 3224 are provided axially on the upper and lower parts of a shaft 3254, respectively. The pass partition plates 3214 and 3224 are plates which feed vertically against the axis of the shaft 3254 a developer by rotation of the shaft 3254, and have a function to scrape up the developer. With the pass partition plates 3214 and 3224, the shaft 3254 is partitioned into two regions A and B. Accordingly, the pass partition plates 3214 and 3224 can be said to form a border. In the present embodiment, the shaft is partitioned into the front and back on the drawing, two regions A and B.

The front and back regions, A and B are provided with independent lateral-feed blade group 3264 and 3274 which are not required to be continuous each other.

Thus, the lateral-feed blades 3264 and 3274 in the front and back regions, A and B, are discontinuous each other, so that pitch, inclination and the like can be freely set. That is, in the present embodiment, the pitch P is designed to differ according to the difference of the place on the shaft 3254. Instead, the inclination is designed to be constant at any place. As a result, as seen from the drawing, although the density of the lateral-feed blades 3264 and 3274 differs with place, a significant reduction of the density as in prior art can be prevented. This is because that the lateral-feed blades 3264 and 3274 in the front and back regions are discontinuous each other and made independent, so that the change of inclination is not required. By such design, without a reduction of lateral-feed force, the lateral-feed force can be properly changed with place.

The mixing roller in the present invention includes the feed roller in addition to the mixing roller in a narrow sense.

The number of the regions partitioned by the border is not restricted to any number of two or more.

Also, the member to form a border may be another member not limited to such pass partition plate, and even the absence of the plate or the member is also acceptable.

The present invention can be applied to mixing rollers for mixing another powder, not limited to image-forming apparatuses.

In the present invention as described above, each lateral-feed blade in a plurality of regions formed by at least two borders formed axially is discontinuous and independent each other, so that pitch, inclination and the like can be freely set, whereby, without a significant reduction of the density of lateral-feed blade group, the lateral-feed capability can be properly changed.

While the preferred form of the present invention has been described, it is understood that modifications will be apparent to those skilled in the art without departing from the spirit of the present invention.

We claim:

1. A feed roller for mixing and feeding a powder comprising:

a first mixing wing provided parallel to a rotating shaft thereof and a second spiral-shaped mixing wing provided diagonally to the shaft, and a spiral-shaped groove for feeding a powder being formed only on a single side and along said second mixing wing, said spiral-shaped groove being located on a forward section with respect to a rotating direction and being on a powder scraping-up side of said roller, said spiral-shaped groove being adjacent essentially an entire length of said second mixing wing, and said first mixing wing not connecting to two adjacent portions of said second spiral-shaped mixing wing, to thereby form said spiral-shaped groove.

2. A feed roller having a shaft and lateral-feed blades fixed to the shaft, for feeding laterally a powder, wherein each lateral-feed blade being constant in pitch and different in size axially.

3. A feed roller having a shaft and lateral-feed blades fixed to the shaft and at least two pass partition plates formed axially, for feeding a powder laterally and longitudinally, wherein:

each of said pass partition plates has an axial size which is different from the axial size of the other pass partition plates.

4. A feed roller having a shaft and lateral feed blades fixed to the shaft, and at least two pass partition plates formed axially, for feeding a powder laterally and longitudinally, wherein:

each lateral feed blade is constant in pitch and different in axial size, and each of said pass partition plates has an axial size which is different from the axial size of the other pass partition plates.

5. A feed roller having a shaft and lateral-feed blades fixed to the shaft, for feeding a powder laterally, wherein:

each lateral-feed blade in a plurality of regions being formed by at least two borders formed axially, said lateral-feed blades being discontinuous and independent from each other, and constant in pitch, said lateral-feed blades inclining in a same direction with the degree of inclination of each of said lateral-feed blades increasing from a first end of the shaft to a second end of the shaft.

6. A feed roller having a shaft and lateral-feed blades fixed to the shaft, for feeding a powder laterally, wherein:

each lateral-feed blade in a plurality of regions being formed by at least two borders formed axially, said lateral-feed blades being discontinuous and independent from each other, and constant in inclination, and each of said lateral-feed blades has a pitch which increases from a first end of said shaft to a second end of said shaft.

7. A feed roller for mixing and feeding a powder comprising:

a first mixing wing provided parallel to a rotating shaft thereof;

a second spiral-shaped mixing wing provided diagonally to the shaft, said second spiral-shaped mixing wing having a first side and a second side, arranged such that the first side of the spiral-shaped mixing wing faces the second side of the spiral-shaped mixing wing;

wherein the first mixing wing is adjacent to the first side of the second spiral-shaped mixing wing and extending toward the second side of the second spiral-shaped mixing wing, but does not connect to the second side, such that a spiral-shaped groove is formed, the spiral-shaped groove being formed near the second side and along the second side of the second mixing wing, said spiral-shaped groove being located on a forward section with respect to a rotating direction and being on a powder scraping-up side of said roller, said spiral-shaped groove being adjacent essentially an entire length of said second mixing wing.

* * * * *